US005779235A

United States Patent [19]

Nakamura

[11] Patent Number: 5,779,235

[45] Date of Patent: Jul. 14, 1998

[54] PAPER FEED APPARATUS

[75] Inventor: Toshihisa Nakamura, Machida, Japan

[73] Assignee: Ricoh Company, Ltd., Tokyo, Japan

[21] Appl. No.: 917,878

[22] Filed: Aug. 27, 1997

Related U.S. Application Data

[63] Continuation of Ser. No. 638,536, Apr. 26, 1996, abandoned.

[30] Foreign Application Priority Data

Apr. 27, 1995 [JP] Japan ..... 7-103986

[51] Int. Cl.[6] ..... B65H 3/44; B65H 5/26

[52] U.S. Cl. ..... 271/9.09; 271/9.12; 271/9.13; 271/162

[58] Field of Search ..... 271/9.01, 9.09, 271/9.11, 9.12, 9.13, 10.11, 265.01, 145, 162, 163, 164

[56] References Cited

U.S. PATENT DOCUMENTS

| | | | |
|---|---|---|---|
| 4,475,731 | 10/1984 | Wood | 271/164 |
| 5,035,413 | 7/1991 | Yamada et al. | 271/9.09 |
| 5,056,768 | 10/1991 | Koyama | 271/9.09 |
| 5,108,084 | 4/1992 | Ishikawa et al. | 271/9.09 |
| 5,346,197 | 9/1994 | Takano et al. | 271/162 |
| 5,573,234 | 11/1996 | Patocchi | 271/9.01 |

FOREIGN PATENT DOCUMENTS

| | | | |
|---|---|---|---|
| 5847732 | 3/1983 | Japan | 271/9.09 |
| 60-6540 | 1/1985 | Japan . | |
| 60-23231 | 2/1985 | Japan . | |
| 403128828 | 5/1991 | Japan | 271/162 |

*Primary Examiner*—H. Grant Skaggs

*Attorney, Agent, or Firm*—Oblon, Spivak, McClelland, Maier & Neustadt, P.C.

[57] ABSTRACT

A paper feed apparatus in an image forming apparatus includes a first paper feed cassette storing first sheets of paper and a first driving device conveying the first sheets of paper one by one from the first paper feed cassette automatically for automatic paper feed. A mount is mounted on the first paper feed cassette and on the mount a second sheet of paper is set for manual paper feed. A second driving device is mounted on the first paper feed cassette and conveys the second sheet of paper set on the mount. The paper feed apparatus achieves a small size and has a low manufacturing cost.

12 Claims, 6 Drawing Sheets

FIG. 10
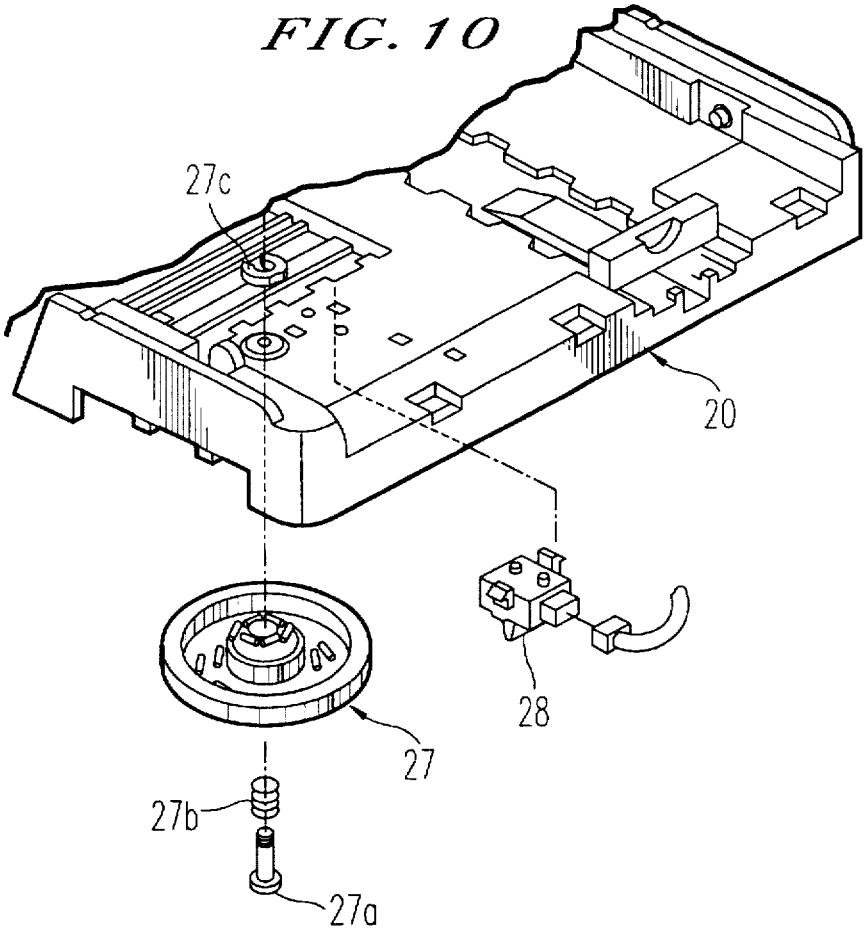
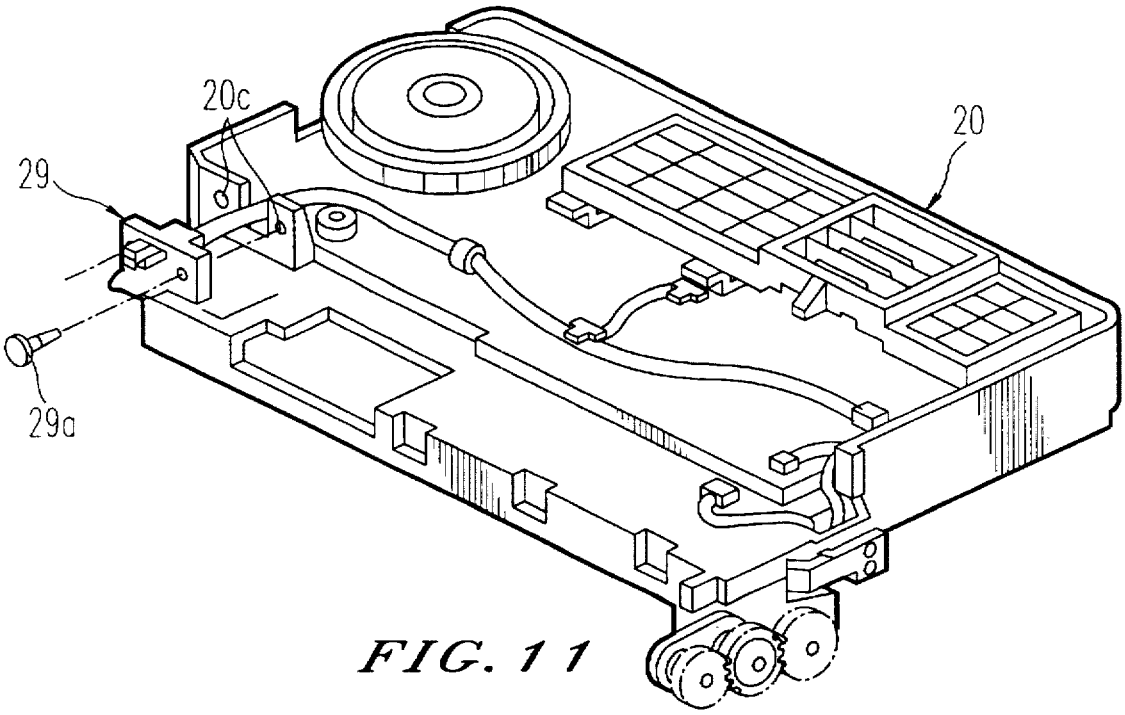
FIG. 11

PAPER FEED APPARATUS

This application is a Continuation of application Ser. No. 08/638,536, filed on Apr. 26, 1996, now abandoned.

BACKGROUND OF THE INVENTION

1. Field of the Invention

The present invention relates to a paper feed apparatus utilized in an image forming apparatus, such as a facsimile machine, copying machine, printer, etc. and particularly relates to a paper feed apparatus which achieves a small size.

2. Discussion of the Background

Recently, sheets of paper which are cut in standard sizes of A4, A3 etc. are generally used instead of roll paper or continuing paper in an image forming apparatus such as a facsimile machine, copying machine, printer, etc. Therefore, a paper feed apparatus which feeds plural cut sheets of paper continuously is employed. Further, the image forming apparatus is also provided with a manual paper feed device in order to use different size sheets. Further, a paper feed cassette which stores sheets of paper is attachably installed so that the sheets are easily supplied to the paper feed apparatus.

According to Japanese Laid Open Patent No. 60-6540, both automatic paper feed and manual paper feed are possible, and this document discloses a method that a tray for manual paper feed is moved at a position of a paper feed roll for automatic paper feed. Moreover, according to Japanese Laid Open Patent No. 60-23231, it is disclosed that to accommodate different size sheets, two convexes are formed in either one of a paper feed cassette and a cassette storage portion and concavities being guided to the convexes are formed in the other of the paper feed cassettes or cassette storage portion, so that precise positioning is achieved when an attachable paper feed cassette is used in a paper feed apparatus.

However, in Japanese Laid Open Patent No. 60-6540, since a conveying path of the automatic paper feed is different from that of the manual paper feed, some devices must be mounted to the apparatus in the case of manual paper feed, and therefore a structure becomes complicated. Also, since a wide space for installing is necessary, a size of the apparatus becomes large and manufacturing cost becomes high. Furthermore, though the structure is that the paper feed roll is used in both the automatic paper feed and the manual paper feed, since the tray for manual paper feed is moved at the position of the paper feed roll, a size of the apparatus becomes large.

Moreover, there is a method that paper feed cassettes are piled up when the paper feed cassettes for automatic paper feed are added in order to use different size sheets of paper. In this method, since cassette storage portions are formed in a lower portion of an apparatus, the apparatus becomes large and manufacturing cost is increased.

Further, in the above apparatus, since the paper feed cassette for storing sheets of paper is attachable, looseness between the paper feed cassette and the cassette storing portion occurs and positioning preciseness between a paper feed roller and the paper feed cassette is lacking. Therefore, distortion of paper conveying occurs and performance of paper conveying is decreased. Moreover, since driving devices such as the paper feed roller, etc., are installed in a main body of the apparatus, maintenance of the driving devices, such as cleaning, exchanging, etc., is difficult and requires much time.

SUMMARY AND OBJECT OF THE INVENTION

Accordingly, one object of the present invention is to provide a novel paper feed apparatus which achieves easy structure, small size and low manufacturing cost.

Another object of the present invention is to provide a novel paper feed apparatus which achieves high performance of paper conveying.

Another object of the present invention is to provide a novel paper feed apparatus which achieves easy maintenance.

These and other objects and advantages are achieved by the present invention which provides a paper feed apparatus in an image forming apparatus including a first paper feed cassette storing sheets of paper, a first driving device conveying the sheets one by one from the first paper feed cassette automatically for automatic paper feed, a mount which is mounted on the first paper feed cassette and on which a sheet of paper is set for manual paper feed, and a second driving device which is mounted on the first paper feed cassette and which conveys the sheet set on the mount. The novel paper feed apparatus of the present invention achieves small size and low manufacturing cost.

BRIEF DESCRIPTION OF THE DRAWINGS

In describing preferred embodiments of the present invention illustrated in the drawings, specified terminology is employed for the sake of clarity. However, the present invention is not intended to be limited to the specific terminology so selected, and it is to be understood that each specific element includes all technical equivalents which operate in a similar purpose.

A more complete appreciation of the present invention and many of the attendant advantages thereof will be readily obtained as the same becomes better understood by reference to the following detailed description, particularly when considered in connection with the accompanying drawings, wherein:

FIG. 10 is an exploded perspective view showing a paper size detection sensor in the second paper feed cassette; and FIG. 11 is an exploded perspective view showing a connecting device for signal transmission between a main body of the image forming apparatus and the second paper feed cassette.

DESCRIPTION OF THE PREFERRED EMBODIMENT

Figure 1:
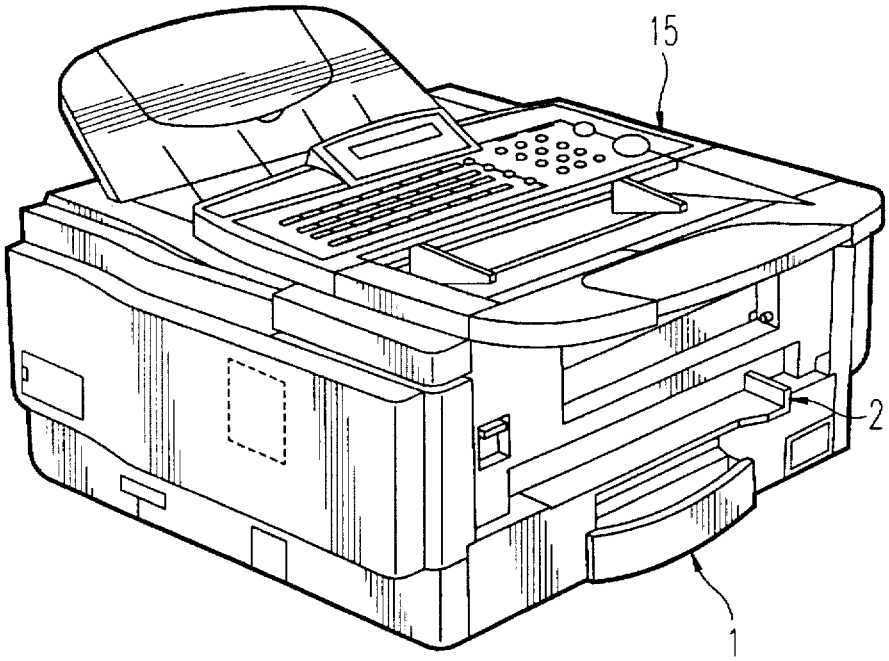
FIG. 1 is a perspective view showing an image forming apparatus employing a paper feed apparatus of a first embodiment of the present invention.
Figure 2:
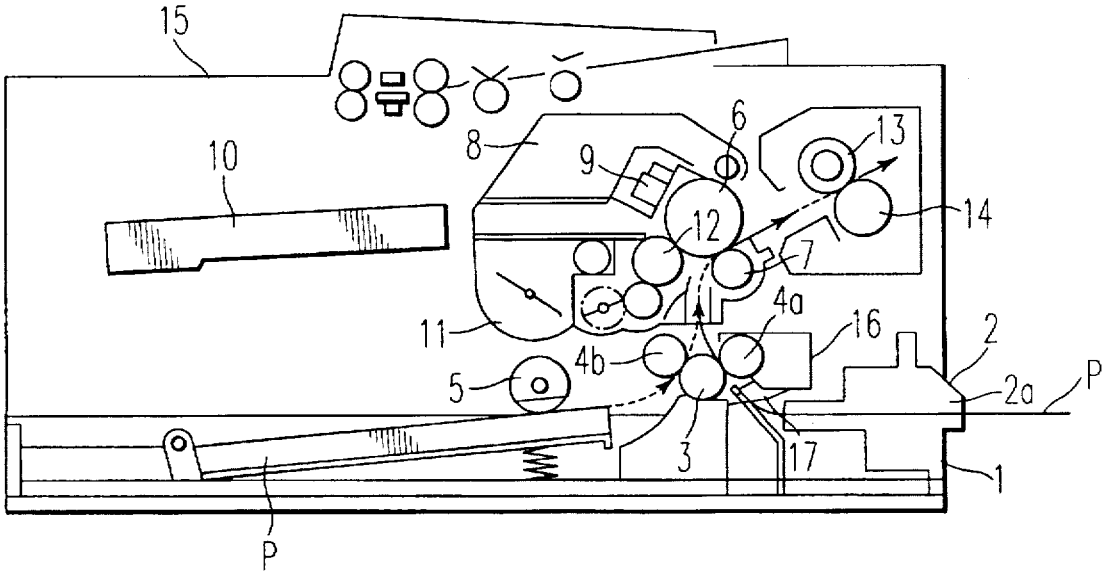
FIG. 2 is a structural view showing an image forming apparatus using the paper feed apparatus of the first embodiment.
Figure 3:
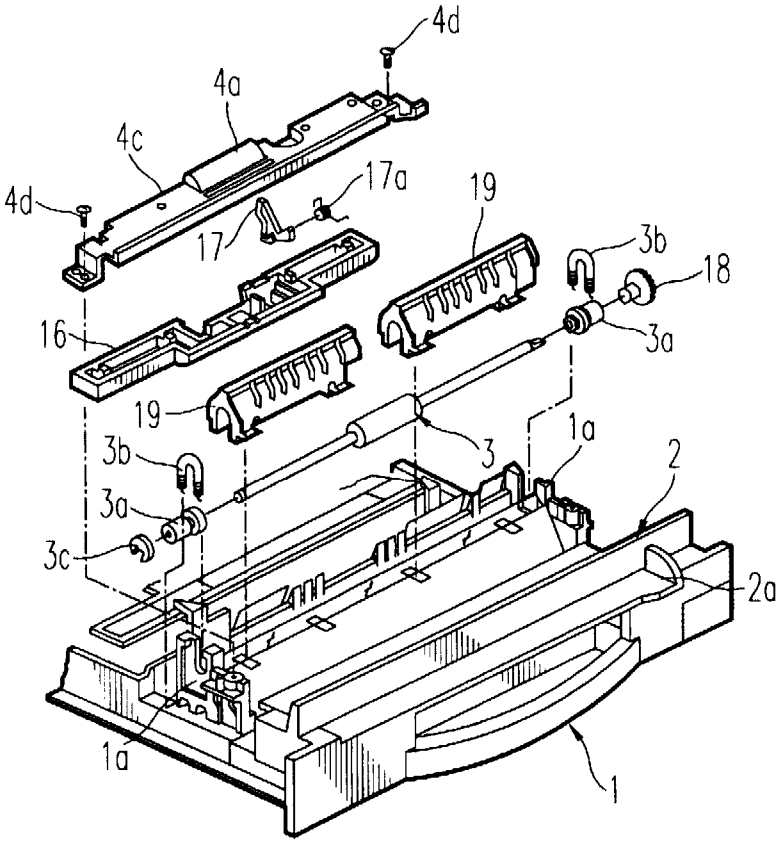
FIG. 3 is an exploded perspective view showing necessary parts for manual paper feed in the paper feed apparatus of the first embodiment.

Referring now to the drawings, embodiments of the present invention will now be described. FIG. 1 is a perspective view showing an image forming apparatus employing a paper feed apparatus of a first embodiment of the present invention. FIG. 2 is a structural view of an image forming apparatus. FIG. 3 is an exploded perspective view showing necessary parts for manual paper feed.

In FIGS. 1 and 2, numeral 1 designates a paper feed cassette, numeral 2 designates a paper setting mount for manual paper feed, numeral 3 designates a resist roller, numerals 4*a* and 4*b* designate conveying rollers, numeral 5 designates a paper feed roller, numeral 6 designates a photoconductive element, numeral 7 designates a transferring roller, numeral 8 designates a charger corona device, numeral 9 designates a cleaning device, numeral 10 designates a laser optical system, numeral 11 designates a toner tank, numeral 12 designates a developing roller, numeral 13 designates a heat roller, numeral 14 designates a pressurizing roller, numeral 15 designates an image forming apparatus, numeral 16 designates an upper guide board, and numeral 17 designates a sensor actuator for manual paper feed.

In the image forming apparatus 15 having the structure as described above, when a sheet of paper $P_1$, is inserted from the paper setting mount for manual paper feed 2 which is installed on the paper feed cassette 1, the sheet $P_1$, is conveyed one by one by the resist roller 3 and the conveying roller 4*a*. On the other hand, when sheets of paper $P_2$ in the paper feed cassette 1 are used, the sheet $P_2$ is separated one by one by the paper feed roller 5 and is conveyed by the resist roller 3 and the conveying roller 4*b*. Then the sheet $P_1$ or $P_2$ is conveyed to between the photoconductive element 6 and the transferring roller 7, synchronized with an image on the photoconductive element 6.

Other devices, such as the charger corona device 8, the cleaning device 9 cleaning residual toner on the photoconductive element 6, the laser optical system 10 forming a latent image on the photoconductive element 6 and the developing roller 12 developing the latent image by the toner supplied in the toner tank, are installed around the photoconductive element 6. Further, the heat roller 13 and the pressurizing roller 14 fix the image transferred on the sheet $P_1$ or $P_2$.

In FIG. 3, numeral 1*a* designates a resist roller supporter, numeral 2*a* designates a paper setting board, numeral 3*a* designates a bearing, numeral 3*c* designates a spring, numeral 4*c* designates a roller bracket, numeral 4*d* designates a screw, numeral 17*a* designates a torsion spring pressuring the sensor actuator for manual paper feed 17 in an opposite direction to the paper conveying direction, numeral 18 designates a gear transmitting a driving force, and numeral 19 designates lower guides.

As shown in FIG. 3, the paper setting mount for manual paper feed 2 and driving parts which are necessary for both the manual paper feed and the automatic paper feed are installed on the paper feed cassette 1. The conveying roller 4*a* is installed to the resist roller supporters la formed in the paper feed cassette in one body, by the two bearings 3*a*, the two springs 3*b*, and the retaining rings 3*c*. The gear 18 which transmits the driving force from the image forming apparatus 15 when the paper feed cassette 1 is set to the image forming apparatus 15 is installed to one side of a shaft of the resist roller 3.

Furthermore, the sensor actuator for manual paper feed 17 is installed on guide board 16 together with the torsion spring 17*a* and is installed to the roller bracket 4*c* by a snap-fit method. The lower guides 19 covering shaft portions of the resist roller 3 by the snap-fit method are installed to the paper feed cassette 1 and the roller bracket 4*c* where the conveying roller 4*a* is installed to the paper feed cassette 1 by the two screws 4*d*.

Figure 4:
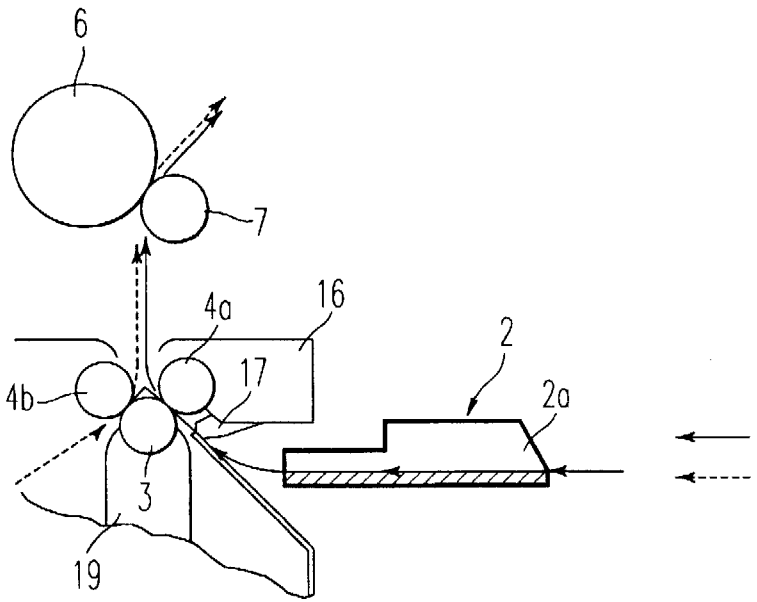
FIG. 4 shows a paper conveying path for manual paper feed in the paper feed apparatus of the first embodiment.

Next, FIG. 4 shows a paper conveying path for the manual paper feed. In the FIG. 4, a solid line designates the paper conveying path for the manual paper feed sheet $P_1$. On the other hand, a paper conveying path for the automatic paper feed $P_2$ is designated by a dashed line. As shown in FIGS. 2 and 4, in the manual paper feed, the paper feed cassette 1 is not removed and is still set to the image forming apparatus 15. The sheet $P_1$ is inserted into the paper setting mount for manual paper feed 17 along the paper setting board 2*a*, referring to FIG. 3. The sheet $P_1$ pushes the sensor actuator for manual paper feed 17, and then the resist roller 3 rotates. The sheet $P_1$ is then conveyed to the photoconductive element 6 by the resist roller 3 and the conveying roller 4*a*. At this time, the rotating direction of the resist roller 3 is reverse to the rotating direction of the resist roller 3 in the automatic paper feed mode.

Figure 5:
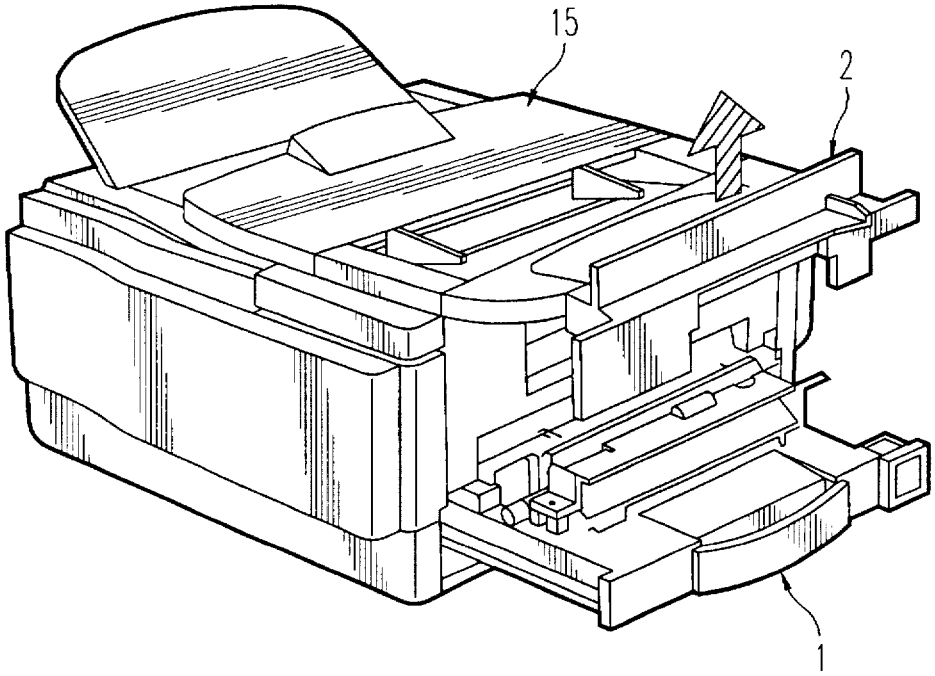
FIG. 5 is a perspective view showing a state in which a paper setting mount for manual paper feed is removed from the paper feed cassette in the paper feed apparatus of the first embodiment.
Figure 6:
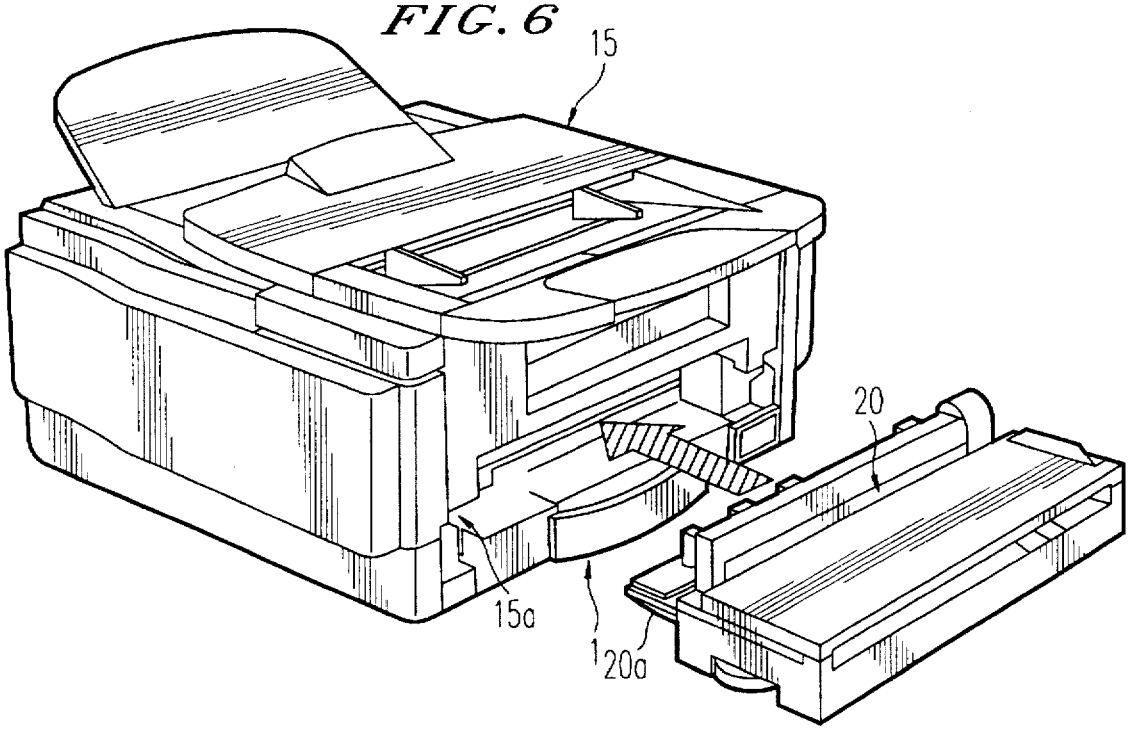
FIG. 6 is a perspective view showing a state in which a second paper feed cassette is placed into a position where the paper setting mount for manual paper feed is removed in the paper feed apparatus of the first embodiment.

FIG. 5 shows the image forming apparatus when the paper setting mount for manual paper feed is removed. As shown in FIG. 5, the paper feed cassette 1 is drawn in a front direction out of the image forming apparatus and the paper setting mount for manual paper feed 2 is pulled up in an upper direction, and as a result, the paper feed cassette 1 can be removed. Further, FIG. 6 shows a state that a second paper feed cassette is set to where the paper setting mount for manual paper feed 2 is removed. Numeral 15*a* designates a concavity of a rail, 20 designates a second paper feed cassette and 20*a* designates a convexity of a rail.

As shown in FIGS. 5 and 6, the paper setting mount for manual paper feed 2 is attachable from the paper feed cassette 1, and it is one portion of a body cover. The second paper feed cassette 20 can be installed to where the paper setting mount for manual paper feed 2 is removed. The concavities 15*a* of the rail which are engaged with the convexities 20*a* of the rail are formed at both sides of the insertion portion of the cassette storage portion and the second feed cassette 20 is slid in the arrow direction as shown in FIG. 6 and is set to the image forming apparatus 15.

As described above, since the paper setting mount for manual paper feed 2 and the driving devices are installed on the paper feed cassette 1, the apparatus can become small in size and have a low manufacturing cost. Further, since the paper setting mount for manual paper feed 2 is used as one portion of the body cover of the apparatus, the apparatus can become small in size. Also, the second paper feed cassette 20 may be of a paper size which is different than that of the paper feed cassette 1, and thus many sizes of sheets of paper can be used. Moreover, though in a background paper feed apparatus, different size paper feed cassettes are piled up in a vertical direction when the different size paper feed cassettes are used, in this embodiment, different sizes sheets of paper can be employed without requiring a large size device.

Next, a second embodiment of the present invention will be described referring to the second paper feed cassette.

Figure 7:
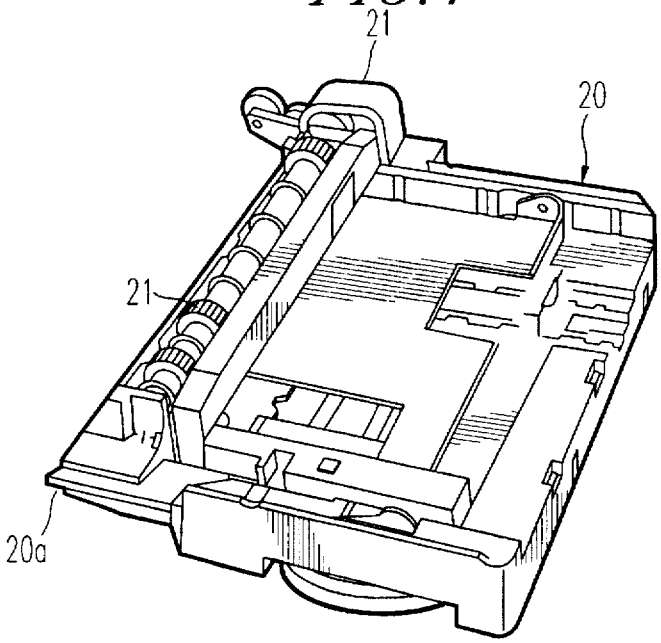
FIG. 7 is a perspective view showing the second paper feed cassette employed in a paper feed apparatus of a second embodiment of the present invention.
Figure 8:
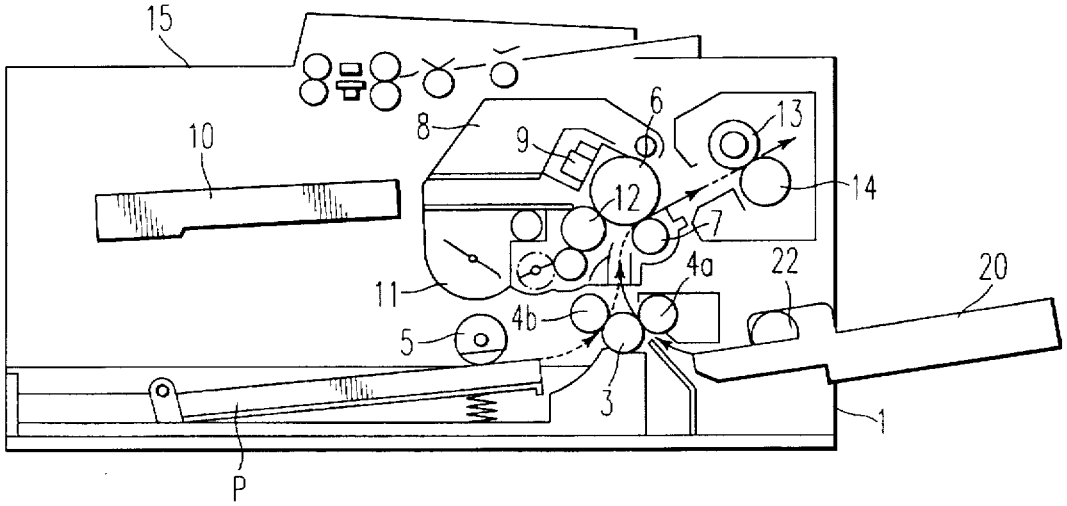
FIG. 8 is a structural view showing an image forming apparatus where the second paper feed cassette is utilized.
Figure 9:
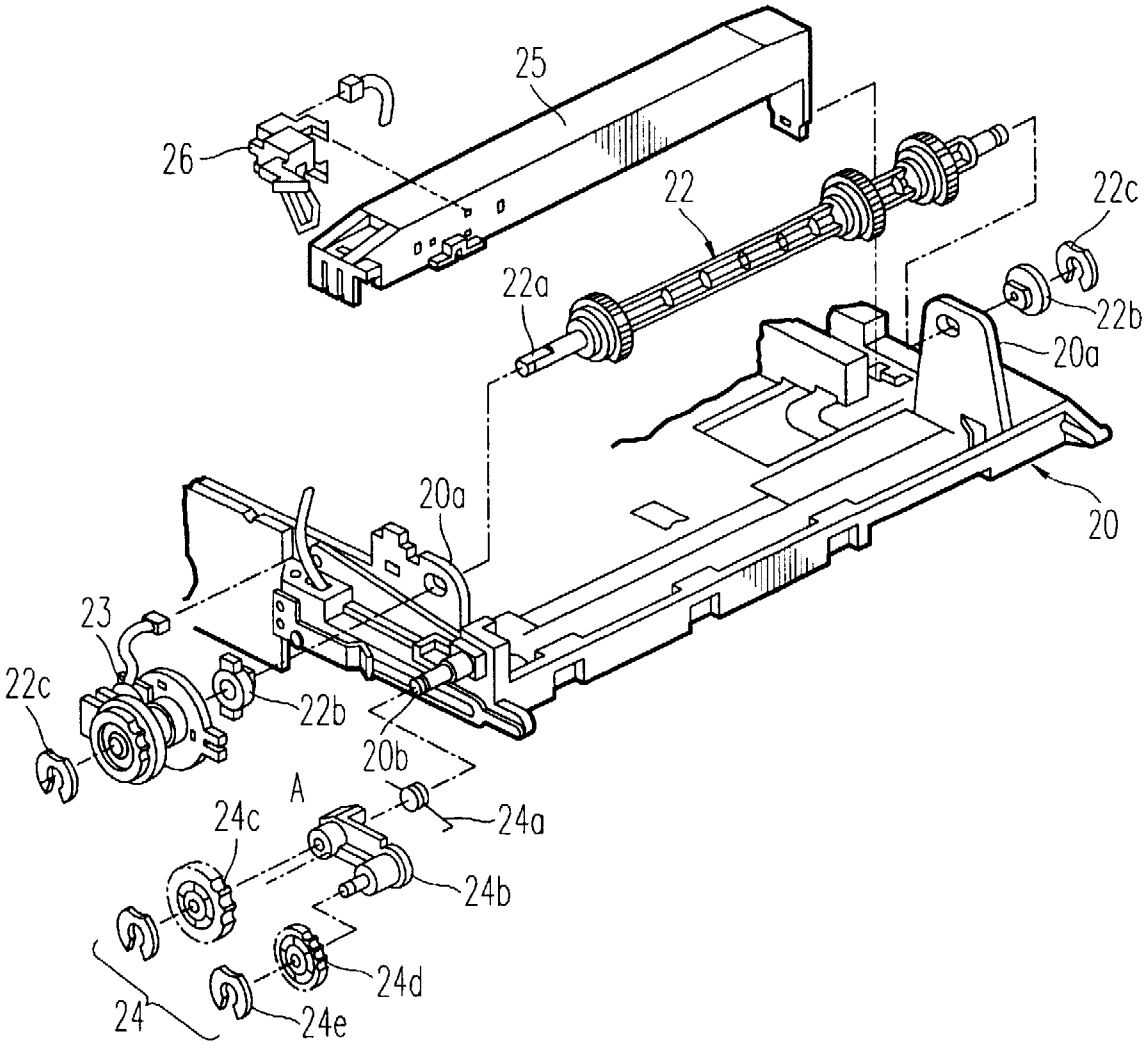
FIG. 9 is an exploded perspective view showing a driving device in the second paper feed cassette.

FIG. 7 is a perspective view showing the second paper feed cassette 20. Numeral 21 designates a driving device. FIG. 8 shows an image forming apparatus where the second feed cassette 20 is installed. FIG. 9 is an exploded perspective view showing the driving device in the second feed cassette 20. In FIG. 9, numeral 20*a* designates a paper feed roller supporter, numeral 20*b* designates a stud, numeral 22*a* designates a shaft, numeral 22 designates a paper feed roller, numeral 22*b* designates a bearing, numeral 22*c* designates a retaining ring, numeral 23 designates a paper feed clutch, numeral 24 designates a transmission gear device, numeral 24*a* designates a torsion spring, numeral 24*b* designates a driving link, numeral 24*c* designates a first gear, numeral 24*d* designates a second gear, numeral 24*e* designates a retaining ring, numeral 25 designates a frame, and numeral 26 designates a paper detecting sensor.

In the second paper feed cassette 20 shown in FIG. 7, the driving device 21 is installed therein. The second feed cassette 20 is placed into the image forming apparatus 20 as shown in FIG. 8 and a paper sheet from the second feed cassette 20 is conveyed on the same conveying path as that of the manual paper feed. Further, the paper feed roller 22 is driven by the paper feed clutch 23 and the transmission gear device 24 as shown in FIG. 9.

The paper feed roller 22 which conveys the paper sheets from the second feed cassette 20 one by one by a separating member (not shown in figures) is installed to the paper feed roller supporter 20*a* formed in the second paper cassette 20 in one body by the bearing 22*b* and the retaining ring 22*c*. The paper feed clutch 23 transmitting the driving force for conveying the paper sheets is installed to the shaft 22*a* of the paper feed roller 22. In the transmission gear device 24 transmitting the driving force from the image forming apparatus 15, the torsion spring 24*a*, the driving link 24*b*, the first gear 24*c*, and the second gear 24*d* are installed to the stud 20*b* formed in the second paper feed cassette 20 in one body.

The combination of the paper feed clutch 23 and the first gear 24*c* and that of the first gear 24*c* and the second gear 24*d* are engaged respectively. Moreover, the driving link 24*b* is pressed by the torsion spring 24*a*.

Next, the paper detecting sensor 26 which detects an existence of the sheet P is installed to the frame by the snap-fit method, and the frame 25 is also installed to the second paper feed cassette 20 by the snap-fit method. Moreover, FIG. 10 is an exploded perspective view showing a paper size detecting sensor device. Numeral 27 designates a paper size detecting board, numeral 27*a* designates a pin, numeral 27*b* designates a coil spring, numeral 27*c* designates a retaining ring, and numeral 28 designates a paper size detecting sensor.

The paper size detecting sensor 28 is installed to the second paper feed cassette 20 by the snap-fit method and the paper size detecting board 27 is installed by the pin 27*a*, the coil spring 27*b* and the retaining ring 27*c*. The paper size detecting board 27 is rotated at a position showing a desired sheet size by manual operation, and the combination with a boss formed in the paper size detecting board 27 is read, and therefore the desired paper size is detected. Detecting signals detected by the detectors in FIGS. 9 and 10 are generated in the order whenever a paper feed requirement by a paper feed signal is generated.

FIG. 11 is an exploded perspective view showing a connecting device for signal transmission connecting the second feed cassette 20 with the main body of the image forming apparatus 15. Numeral 20*c* designates mounting members, numeral 29 designates a connector, and numeral 29*a* designates a snap-fit pin.

The connector 29 is mounted to the mounting members 20*c* formed in the second paper feed cassette in one body by the snapfit pin. A signal line connected with the connector 29 is connected with the paper feed clutch and the sensors. When the second paper feed cassette is set in the image forming apparatus, a connector in the image forming apparatus is connected with the connector 29 in the second paper feed cassette 20, and then signals are transmitted.

As described above, when the paper feed requirement is generated, the signals are transmitted by way of the connector 29. The existence of the paper sheet and the size of the paper sheet are detected in the order by the paper detecting sensor 26 and the paper size detecting sensor 28. The paper feed clutch 23 operates and the paper sheets from the second feed cassette 20 are conveyed by the paper feed roller 22 and the separating member one by one. Then the paper sheets are conveyed to the photoconductive element by the resist roller 3 and the conveying roller 4*a*.

In the background apparatus, the performance of paper conveying is changed and is rendered unstable by the relationship of the position between the paper feed roller 22 and both corners of the sheet P engaging with the separating member. On the other hand, in this embodiment of the present invention, since the second paper feed cassette 20 is provided with the driving device 21 such as the paper feed roller 22 and transmission gear device 24, the relationship of the position between the paper feed roller 22 and both corners of the sheet P can become precise, and thereby the performance of paper conveying can be improved. Furthermore, the second paper feed cassette 20 is provided with the driving device and the detecting device, but such devices can be easily taken out from the image forming apparatus, and therefore easy maintenance, such as cleaning and exchanging, can be achieved.

In the second embodiment, though it is described that the second paper feed cassette 20 is provided with the driving device and the detecting device, the paper feed cassette 20 can be provided with the driving device and the detecting device.

The technical advantages of the present invention are now further described.

According to the present invention, since the paper feed cassette is provided with a driving device and a paper setting mount for manual paper feed, the image forming apparatus can become small in size and have a low manufacturing cost.

Further, since the paper setting mount for manual paper feed is one portion of the body cover of the image forming apparatus, the image forming apparatus can become small in size.

Further, since the second paper feed cassette is placed into the image forming apparatus, many sizes sheets of paper can be used.

Further, since the driving device is installed in the paper feed 1 and/or the second paper feed cassette 20, the performance of paper conveying can be improved and the reliability of the apparatus can be improved.

Moreover, since the driving device and the detecting device are installed in the paper feed 1 and/or the second paper feed cassette 20, easy maintenance of the driving device and the detecting device, such as cleaning and exchanging, can be achieved and the reliability of the apparatus can be improved.

Obviously, numerous additional modifications and variations of the present invention are possible in light of the above teachings. It is therefore to be understood that, within the scope of the appended claims, the present invention may be practiced otherwise than as specifically described herein.

What is claimed as new and desired to be secured by Letters: Patent of the United States is:

1. A paper feed apparatus in an image forming apparatus, comprising:

a first paper feed cassette storing first sheets of paper;

a first driving device conveying the first sheets of paper one by one from the first paper feed cassette automatically for automatic paper feed;

a removable mount which is mounted on the first paper feed cassette and on which a second sheet of paper is set for manual paper feed;

a second driving device which is mounted on the first paper feed cassette and which conveys the second sheet of paper set on the mount;

wherein a second paper feed cassette storing third sheets of paper for automatic paper feed is attachable to a portion of the first paper feed cassette apparatus from which the mount is removed.

2. A paper feed apparatus in an image forming apparatus of claim 1, wherein the mount is a portion of a body cover of the image forming apparatus.

3. A paper feed apparatus in an image forming apparatus, comprising:

a first paper feed means for storing first sheets of paper;

a first conveying means for conveying the first sheets of paper one by one from the first paper feed means automatically for automatic paper feed;

a removable mounting means mounted on the first paper feed means and on which a second sheet of paper is set for manual paper feed;

a second conveying means mounted on the first paper feed cassette for conveying the second sheet of paper set on the mounting means;

wherein a second paper feed means for storing third sheets of paper for automatic paper feed is attachable to a portion of the first paper feed cassette from which the mounting means is removed.

4. A paper feed apparatus in an image forming apparatus of claim 3, wherein the mounting means is a portion of a body cover of the image forming apparatus.

5. A paper feed apparatus in an image forming apparatus of claim 3, further comprising a detecting means for detecting the first sheets of paper, and wherein the detecting means is attachable installed on the first paper feed means.

6. A paper feed apparatus in an image forming apparatus of claim 3, further comprising a connecting means for connecting the first paper feed means with the image forming apparatus for signal transmission, and wherein the connecting means is installed on the first paper feed means.

7. A paper feed apparatus in an image forming apparatus, comprising:

a first paper feed cassette storing first sheets of paper;

a first driving device dedicated to convey only the first sheets of paper one by one from the first paper feed cassette automatically for automatic paper feed;

a removable mount which is mounted on the first paper feed cassette and on which a second sheet of paper is set for manual paper feed;

a second driving device which is mounted on the first paper feed cassette and which is dedicated to convey the second sheet of paper set on the mount;

wherein a second paper feed cassette storing third sheets of paper for automatic paper feed is attachable to a portion of the first paper feed cassette from which the mount is removed.

8. A paper feed apparatus in an image forming apparatus of claim 7, wherein the mount is a portion of a body cover of the image forming apparatus.

9. A paper feed apparatus in an image forming apparatus, comprising:

a paper feed means for storing first sheets of paper;

a first conveying means dedicated for conveying only the first sheets of paper one by one from the first paper feed means automatically for automatic paper feed;

a removable mounting means mounted on the first paper feed means and on which a second sheet of paper is set for manual paper feed;

a second conveying means mounted on the first paper feed cassette and dedicated for conveying the second sheet of paper set on the mounting means;

wherein a second paper feed means for storing third sheets of paper for automatic paper feed is attachable to a portion of the first paper feed means from which the mounting means is removed.

10. A paper feed apparatus in an image forming apparatus of claim 9, wherein the mounting means is a portion of a body cover of the image forming apparatus.

11. A paper feed apparatus in an image forming apparatus of claim 9, further comprising a detecting means for detecting the first sheets of paper, and wherein the detecting means is attachable installed on the first paper feed means.

12. A paper feed apparatus in an image forming apparatus of claim 9, further comprising a connecting means for connecting the first paper feed means with the image forming apparatus for signal transmission, and wherein the connecting means is installed on the first paper feed means.

* * * * *